US005967117A

United States Patent [19]

Wenzlawski et al.

[11] Patent Number: 5,967,117

[45] Date of Patent: Oct. 19, 1999

[54] METHOD FOR DETERMINING A ROTATIONAL SPEED FOR AN IDLING CONTROL OF AN INTERNAL COMBUSTION ENGINE

[75] Inventors: Klaus Wenzlawski, Nürnberg; Benno Larisch, Schwandorf; Hellmut Freudenberg, Pentling, all of Germany

[73] Assignee: Siemens Aktiengesellschaft, Munich, Germany

[21] Appl. No.: 08/940,470

[22] Filed: Sep. 30, 1997

[30] Foreign Application Priority Data

Sep. 30, 1996 [DE] Germany ..... 196 40 429

[51] Int. Cl.[6] ..... F02D 41/16

[52] U.S. Cl. ..... 123/339.19

[58] Field of Search ..... 123/339.1, 339.14, 123/339.19, 350, 352

[56] References Cited

U.S. PATENT DOCUMENTS

| | | | |
|---|---|---|---|
| 4,344,397 | 8/1982 | Geiger et al. | 123/339.19 |
| 4,509,477 | 4/1985 | Takao et al. | 123/339.19 |
| 4,527,422 | 7/1985 | Honig et al. | 73/115 |
| 4,582,031 | 4/1986 | Janetzke et al. | 123/339.14 |
| 4,630,582 | 12/1986 | Kuttner et al. | 123/339.14 |
| 4,750,460 | 6/1988 | Peter | 123/339.19 |
| 5,012,779 | 5/1991 | Fukui et al. | 123/339.19 |
| 5,726,892 | 3/1998 | Tang et al. | 123/352 |

FOREIGN PATENT DOCUMENTS

3609245C2 1/1989 Germany .

*Primary Examiner*—Willis R. Wolfe
*Assistant Examiner*—Hieu T. Vo
*Attorney, Agent, or Firm*—Herbert L. Lerner; Laurence A. Greenberg

[57] ABSTRACT

A method for determining a rotational speed for an idling control of an internal combustion engine, in particular of a diesel internal combustion engine with an idling controller, includes using a change in a so-called current rotational speed in relation to a previous rotational speed as an input variable for the idling controller. The change is composed of an expansion rotational speed of the respectively last cylinder and of a previously calculated, weighted compression rotational speed of the current cylinder. The expansion rotational speeds of the last two cylinders, as well as the difference between them and the last compression rotational speed are used for that purpose.

3 Claims, 1 Drawing Sheet

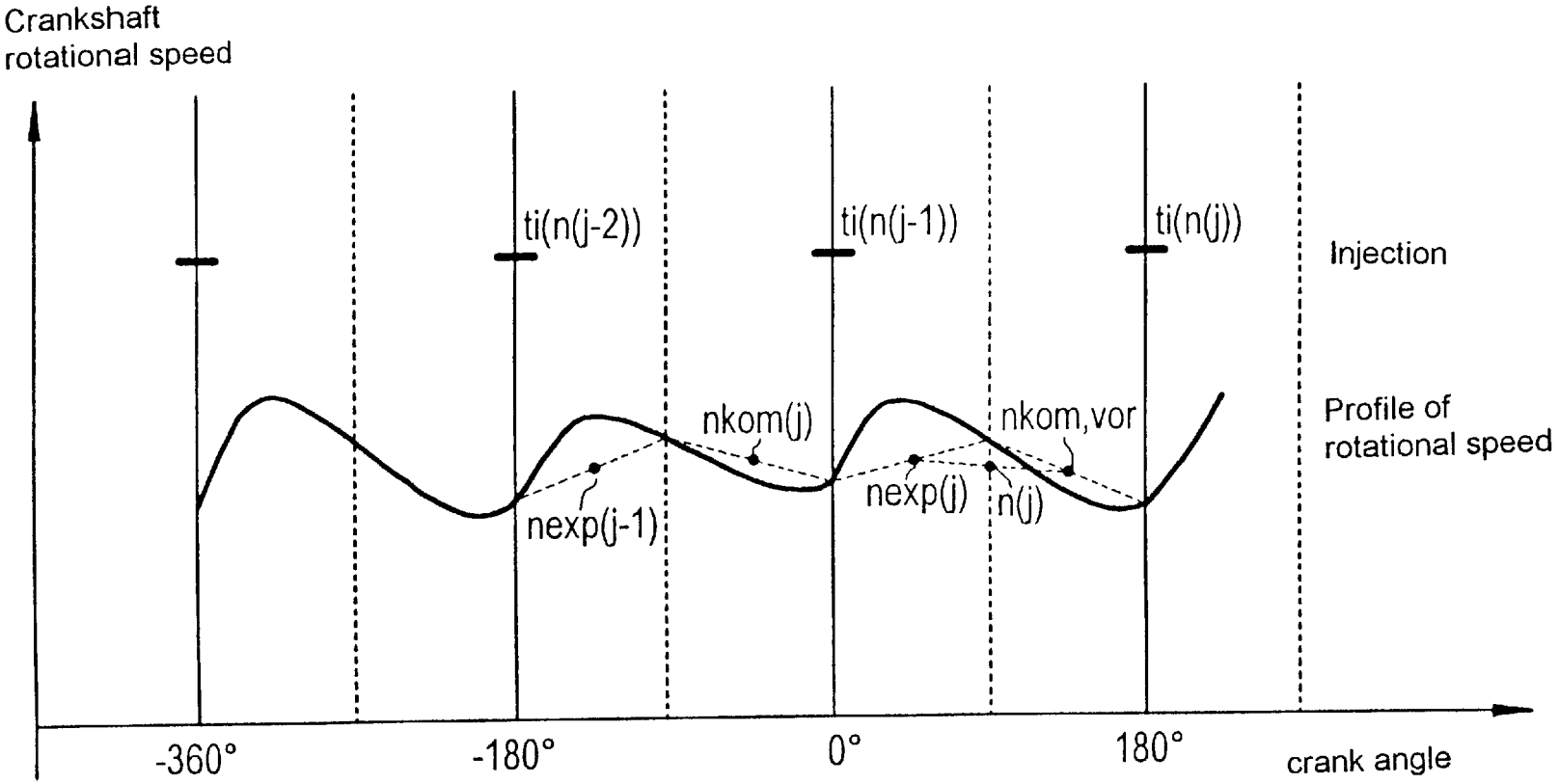
Crankshaft rotational speed
Injection
Profile of rotational speed
crank angle
ti(n(j-2))
ti(n(j-1))
ti(n(j))
nexp(j-1)
nkom(j)
nexp(j)
nkom,vor
n(j)
-360°
-180°
0°
180°

METHOD FOR DETERMINING A ROTATIONAL SPEED FOR AN IDLING CONTROL OF AN INTERNAL COMBUSTION ENGINE

BACKGROUND OF THE INVENTION

FIELD OF THE INVENTION

The invention relates to a method for determining a rotational speed for an idling control of an internal combustion engine, in particular of a diesel internal combustion engine with an idling controller.

Critical operating ranges of a diesel internal combustion engine are idling and low partial load. Although consumption values are very favorable in that operating range in comparison with a spark ignition engine, in modern diesel internal combustion engines the idling speed is reduced further for reasons of economy. However, since there is an increase in idling noises, in particular so-called knocking as the idling speed decreases, and there is a risk of the internal combustion engine stalling at an excessively low rotational speed, precise determination of the rotational speed is becoming increasingly significant for idling control.

German Patent DE 36 09 245 C2 discloses a device for controlling the idling speed of a multi-cylinder internal combustion engine, in particular a diesel internal combustion engine with a proportional-integral-differential controller (PID controller), in which device an average rotational speed and a cylinder-specific rotational speed are measured and evaluated using marks on the crankshaft. An individual cylinder control is used to carry out a fuel correction as a function of those measurements by changing control constants of the PID controller so that the smoothness of the running is improved.

SUMMARY OF THE INVENTION

It is accordingly an object of the invention to provide a method for determining a rotational speed for an idling control of a multi-cylinder internal combustion engine, which overcomes the hereinafore-mentioned disadvantages of the heretofore-known methods of this general type and which ensures a high level of accuracy and satisfactory idling of the internal combustion engine.

With the foregoing and other objects in view there is provided, in accordance with the invention, a method for determining a rotational speed for idling control of an internal combustion engine, in particular of a diesel internal combustion engine with an idling controller, which comprises measuring rotational speeds during expansion and compression of successive working cycles of an internal combustion engine; using a rotational speed value of a current cylinder composed of an expansion rotational speed of a respective last cylinder and a previously calculated compression rotational speed, weighted with a weighting factor, as an input variable for an idling controller; and determining the previously calculated compression rotational speed from expansion rotational speeds of a last two cylinders and from a last compression rotational speed.

In accordance with another mode of the invention, there is provided a method which comprises calculating the rotational speed $n_j$ according to the following relationship $$n_j=\{n_{exp,j}+[n_{j-z}+((n_{exp,j}-(n_{exp,j-1}-n_{exp,j})*A)-n_{kom,j})]*B\}/2$$

wherein:

| | |
|---|---|
| $n_j$ | current rotational speed |
| $n_{j-z}$ | previous rotational speed |
| $n_{exp,j}$ | expansion rotational speed of the last cylinder |
| $n_{exp,j-1}$ | expansion rotational speed of the next to the last cylinder |
| $n_{kom,vor}$ | previously calculated compression rotational speed = $n_{exp,j} - (n_{exp,j-1}-n_{exp,j})*A$ |
| $n_{kom,j}$ | last compression rotational speed |
| j | counting variable |
| z | cylinder number |
| A, B | weighting constants. |

In accordance with a concomitant mode of the invention, there is provided a method which comprises experimentally determining the weighting constants A,B on a test bed with each having values between 0 and 1.

The advantage of the use of a compression rotational-speed difference to determine an expansion rotational speed is that even in injection systems in which it is not possible to measure the rotational speed directly before the injection process and thus no current value for the rotational speed is available, the rotational speed is determined with a high level of accuracy and can be used for the idling control.

Other features which are considered as characteristic for the invention are set forth in the appended claims.

Although the invention is illustrated and described herein as embodied in a method for determining a rotational speed for an idling control of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The FIGURE of the drawing is a diagram showing a profile of a crankshaft rotational speed of a 4-cylinder diesel internal combustion engine as a function of a crank angle in degrees.

DESCRIPTION OF THE PREFERRED EMBODIMENTS

Referring now in detail to the single figure of the drawing, it is seen that herein reference symbol $N_{exp,j}$ designates a rotational speed during an expansion cycle, and reference symbol $n_{kom,j}$ designates a rotational speed during a compression cycle, for a segment j in each case. Times during which fuel is injected are indicated in the diagram with horizontal bars and are designated by reference symbols $ti(n_{j-2})$, $ti(n_{j-1})$ and $ti(n_j)$.

A change in a so-called current rotational speed $n_j$ in relation to a previous rotational speed $n_{j-z}$ is used as rotational speed information, and thus as an input variable for an idling controller, which is preferably configured as a PID controller. It is composed of the expansion rotational speed of the respective last cylinder $n_{exp,j}$ and of a previously calculated, weighted compression rotational speed $n_{kom,vor}$ of the current cylinder. The expansion rotational speeds of the last two cylinders $n_{exp,j}$ and $n_{exp,j-1}$, as well as a difference between them and the last compression rotational speed $n_{kom,j}$ are used for this purpose:

$$n_j=\{n_{exp,j}+[n_{j-z}+((n_{exp,j}-(n_{exp,j-1}-n_{exp,j})\cdot A)-n_{kom,j})]*B\}/2$$

wherein:

| | |
|---|---|
| $n_j$ | current rotational speed |
| $n_{j-z}$ | previous rotational speed |
| $n_{exp,j}$ | expansion rotational speed of the last cylinder |
| $n_{exp,j-1}$ | expansion rotational speed of the next to the last cylinder |
| $n_{kom}$ | compression rotational speed |
| $n_{kom,vor}$ | previously calculated compression rotational speed = $n_{exp,j} - (n_{exp,j-1}-n_{exp,j})*A$ |
| $n_{kom,j}$ | last compression rotational speed |
| j | counting variable |
| z | cylinder number |
| A, B | weighting constants, which are determined experimentally on the test bed and to which the following applies: $0 < A, B < 1$. |

We claim:

1. A method for determining a rotational speed for idling control of an internal combustion engine, which comprises:

measuring rotational speeds during expansion and compression of successive working cycles of an internal combustion engine;

calculating a current rotational speed from an expansion rotational speed of a respective last cylinder and a previously calculated compression rotational speed of a current cylinder, weighted with a weighting factor, and using the current rotational speed as an input variable for an idling controller; and determining the previously calculated compression rotational speed from expansion rotational speeds of a last two cylinders and from a last compression rotational speed.

2. The method according to claim 1, which comprises calculating the current rotational speed $n_j$ according to the following relationship:

$$n_j=\{n_{exp,j}+[n_{j-z}+((n_{exp,j}-(n_{exp,j-1}-n_{exp,j})*A)-n_{kom,j})]*B\}/2$$

wherein:

| | |
|---|---|
| $n_j$ | current rotational speed |
| $n_{j-z}$ | previous rotational speed |
| $n_{exp,j}$ | expansion rotational speed of the last cylinder |
| $n_{exp,j-1}$ | expansion rotational speed of the next to the last cylinder |
| $n_{kom,vor}$ | previously calculated compression rotational speed = $n_{exp,j} - (n_{exp,j-1}-n_{exp,j})*A$ |
| $n_{kom,j}$ | last compression rotational speed |
| j | counting variable |
| z | cylinder number |
| A, B | weighting constants. |

3. The method according to claim 2, which comprises experimentally determining the weighting constants A,B on a test bed with each having values between 0 and 1.

* * * * *